US006676424B2

(12) United States Patent
Ferranti et al.

(10) Patent No.: US 6,676,424 B2
(45) Date of Patent: Jan. 13, 2004

(54) APPARATUS AND METHOD FOR EFFECTING ELECTRICAL CONNECTION BETWEEN A POWER SOURCE AND EQUIPMENT

(75) Inventors: Stephen Ferranti, Rowlett, TX (US); Stephen C. Frazier, Garland, TX (US); Mark A. Haisler, Rowlett, TX (US); Michael Clyde Steeves, Garland, TX (US)

(73) Assignee: Tyco Electronics Logistics A.G., Steinbach (CH)

( * ) Notice: Subject to any disclaimer, the term of this patent is extended or adjusted under 35 U.S.C. 154(b) by 49 days.

(21) Appl. No.: 10/060,726

(22) Filed: Jan. 30, 2002

(65) Prior Publication Data

US 2003/0143881 A1 Jul. 31, 2003

(51) Int. Cl.[7] ..... H01R 4/60
(52) U.S. Cl. ..... 439/213; 439/507
(58) Field of Search ..... 439/213, 507; 361/803, 825, 827, 826; 429/159, 160

(56) References Cited

U.S. PATENT DOCUMENTS 3,035,242 A * 5/1962 Sloop ..... 439/508
5,816,850 A * 10/1998 Yamada et al. ..... 439/507
6,436,570 B1 * 8/2002 Chalasani et al. ..... 429/121

* cited by examiner

*Primary Examiner*—Neil Abrams
*Assistant Examiner*—Phuong Dinh
(74) *Attorney, Agent, or Firm*—Law Office of Donald D. Mondul

(57) ABSTRACT

An apparatus for effecting electrical connection between a power source and equipment includes: (a) a first conductor having a first aperture; (b) a second conductor having a second aperture; (c) an insulator having a connecting bore coaxial with the first and second apertures to establish a bridging passage extending a bridging distance to traverse the first conductor, the insulator and the second conductor when assembled with the first conductor and the second conductor substantially parallel separated by the insulator; and (d) a bridge having an axial length at least equal with the bridging distance and a transaxial dimension less than the passage diameter and having a first engagement structure in the first aperture and a second engagement structure in the second aperture when the bridge is engaged; the bridge is removable from engagement to interrupt electrical connection between the power source and the equipment.

10 Claims, 10 Drawing Sheets

APPARATUS AND METHOD FOR EFFECTING ELECTRICAL CONNECTION BETWEEN A POWER SOURCE AND EQUIPMENT

BACKGROUND OF THE INVENTION

The present invention is directed to electrical power connections, and especially to electrical power connections for use in equipment cabinets where a low profile is desirable for such connections in order to conserve space.

Power cabinet installations typically contain shelves of battery strings that maintain the output voltage for equipment or to equipment during AC utility outages. The battery strings require routine maintenance during which the strings must be disconnected from the plant output voltage so that an accidental short during the maintenance procedure does not shut the plant down. Typically this disconnection is accomplished using commercially available battery disconnect switches. However, at high current levels (e.g., 200 Amp and above) the commercially available battery disconnect switches are unacceptable large and expensive. As power density requirements for DC battery plants increase, the size of the required disconnect devices becomes prohibitive.

The trend in today's electrical products is largely toward smaller products. For example, telecommunication switches are becoming smaller as they are installed in population-dense areas rather than in wide-open fields. Other electrical and communication products are similarly tending toward smaller product configurations.

There is a need for a compact, quick disconnect switch having capacity for handling high currents for use in disconnecting power from equipment, including plant power supply equipment. There is a special need for a compact high current quick disconnect switch for disconnecting back-up batteries from equipment and from house-supplied power circuits.

SUMMARY OF THE INVENTION

An apparatus for effecting electrical connection between a power source and equipment includes: (a) a first conductor having a first aperture; (b) a second conductor having a second aperture; (c) an insulator having a connecting bore coaxial with the first and second apertures to establish a bridging passage extending a bridging distance to traverse the first conductor, the insulator and the second conductor when assembled with the first conductor and the second conductor substantially parallel separated by the insulator; and (d) a bridge having an axial length at least equal with the bridging distance and a transaxial dimension less than the passage diameter and having a first engagement structure in the first aperture and a second engagement structure in the second aperture when the bridge is engaged; the bridge is removable from engagement to interrupt electrical connection between the power source and the equipment.

Because of the significant weight of the battery strings in many equipment cabinets (typically above 100 pounds per shelf), many battery shelves contain reinforcing flanges oriented substantially perpendicular with the plane of the shelf. Such reinforcing flanges help to stiffen and strengthen the shelf structure. Some stiffening flanges are located at the front of the shelf running across the shelf width. The preferred embodiment of the apparatus of the present invention fits within the profile of such a stiffening flange for a battery shelf. By such a configuration, no significant extra space is required for accommodating disconnect switches configured according to the present invention.

The invention is preferably embodied in a low profile, low cost, high current battery disconnect switching apparatus that employs a pin and socket type of interconnect between power supply (e.g., batteries) and equipment. The apparatus can handle extremely high battery currents (e.g., up to 400 Amps). Moreover, the apparatus is configured to easily accommodate parallel or serial connection between power supply (e.g., batteries) and equipment, thereby permitting flexibility in designing current handling capacity for particular embodiments of the apparatus. The apparatus preferably is comprised of two elements. A receptacle element includes, by way of example and not by way of limitation, two sets of conductive members or bus bars separated by an insulator. The insulator provides the requisite separation of the bus bars to preclude shorting or arcing and provides flanges for mounting the apparatus in a cabinet, for example to a battery shelf. In the exemplary embodiment, one set of bus bars is connected to the either the positive or negative side of the battery string via a cable lug mounted to a stud in the bus bar. The other set of bus bars is connected directly to the plant voltage via either cable or bus bar. The apparatus is preferably mounted into the front edge of the battery shelf and takes up a frontal area of approximately 0.75"×8.5". Alternatively, the apparatus may be mounted in a vertical strength member or other structural member and occupy a similar frontal area.

The second element of the apparatus is a pin assembly configured for insertion into aligned apertures in the two sets of bus bars and the insulator. The pin assembly passes the battery current from one set of bus bars (e.g., the battery-connected bus bars) to the other set of bus bars (e.g., the plant output-connected bus bars). The pin assembly preferably includes a brass shaft with channels machined-in to retainingly receive two flexible conducting engaging collars for providing reliable electrical contact with each of the sets of bus bars. The pin assembly is preferably equipped with a handle to facilitate easy insertion and removal as well as to provide a positive stop for the pin to prevent over-insertion or under-insertion. When the pin assembly is removed from the apparatus the electrical connection between the two sets of bus bars is broken, thereby disconnecting the plant output from the battery terminals. In such manner, the battery string is easily disconnected and ready for maintenance. Any arcing which may occur during the disconnection process is contained within the insulator, thereby protecting both the user and the equipment from damage.

The disconnect apparatus is preferably modular in construction. Each pin can handle, for example, up to 200 Amps of battery current, so for applications up to 200 Amps only one disconnecting pin is required. For higher current applications a second pin may be added in parallel with the first pin to increase the current-carrying capacity of the apparatus. In such configurations, it is preferred that pin assemblies be ganged together to ensure that the multiple pin assemblies are inserted and removed substantially simultaneously in order to avoid having one of the pin assemblies carrying greater than its capacity of current even for a short period. Such a modular construction design provides a cost-effective solution that accommodates current capacity growth along with plant growth as systems expand.

It is therefore an object of the present invention to provide an apparatus and method for effecting electrical connection between a power source and equipment that is preferably embodied in a compact, quick disconnect switch having capacity for handling high currents.

It is a further object of the present invention to provide an apparatus and method for effecting electrical connection between a power source and equipment that is configured for employment as a compact high current quick disconnect switch for disconnecting back-up batteries from equipment and from house-supplied power circuits.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
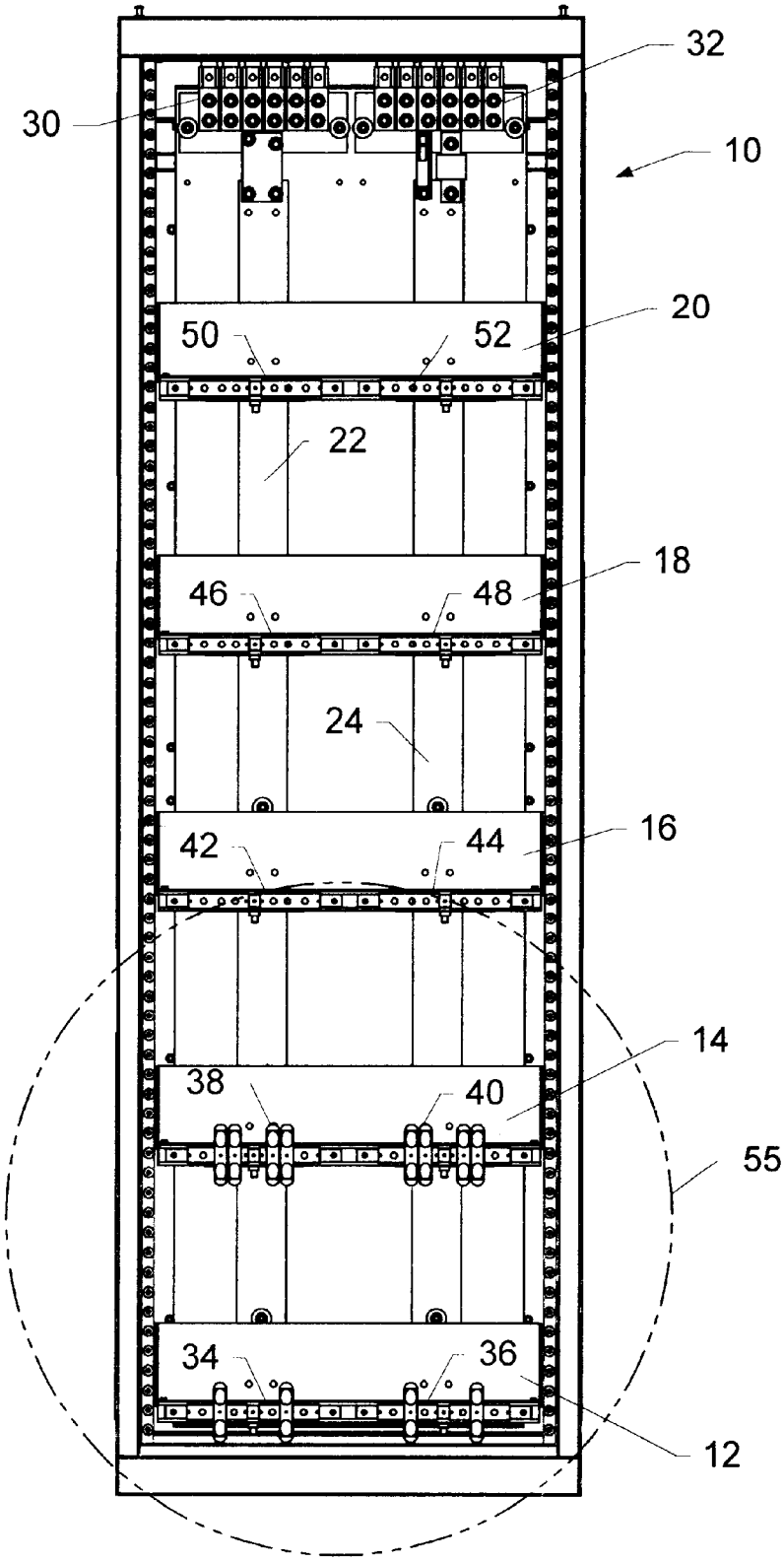
FIG. 1 is a front elevation view of a representative equipment cabinet with which the apparatus of the present invention is used.

FIG. 1 is a front elevation view of a representative equipment cabinet with which the apparatus of the present invention is used. In FIG. 1, a cabinet 10 includes a plurality of shelves 12, 14, 16, 18, 20. Representative cabinet 10 is a battery cabinet so that each shelf 12, 14, 16, 18, 20 is configured for accommodating and connecting batteries (not shown in FIG. 1). Alternate cabinet arrangements may provide for only one or two shelves (e.g., shelves 12, 14) to accommodate batteries while remaining shelves (e.g., shelves 16, 18, 20) support equipment.

In representative battery cabinet 10 there are bus bars 22, 24 coupled with respective shelves 12, 14, 16, 18, 20 for delivering battery power to rectifier connection arrays 30, 32. Rectifier connection arrays 30, 32 are a power supply locus to which plant power (i.e., power supplied by plant-generated means) is applied and to which battery power is supplied via bus bars 22, 24. Battery power is provided for back-up to plant power in the event plant power is interrupted. Circuitry (not shown in FIG. 1) provides for smooth hand-over of power supply from plant-supplied power to battery power under predetermined conditions. Bus bars 22, 24 are coupled selectively with connection assemblies located at the front edge of each respective shelf 12, 14, 16, 18, 20. Connection of bus bars is characterized as being selectively effected because connection of batteries may be made in parallel, in series or in a combination of parallel and series connections depending upon the particular application with which cabinet 10 is to be employed. Thus, there are connection assemblies 34, 36 at the front edge of shelf 12. There are connection assemblies 38, 40 at the front edge of shelf 14. There are connection assemblies 42, 44 at the front edge of shelf 16. There are connection assemblies 46, 48 at the front edge of shelf 18. There are connection assemblies 50, 52 at the front edge of shelf 20. The general area of cabinet 10 indicated by dotted-line circle 55 is illustrated in greater detail in FIG. 2.

Figure 2:
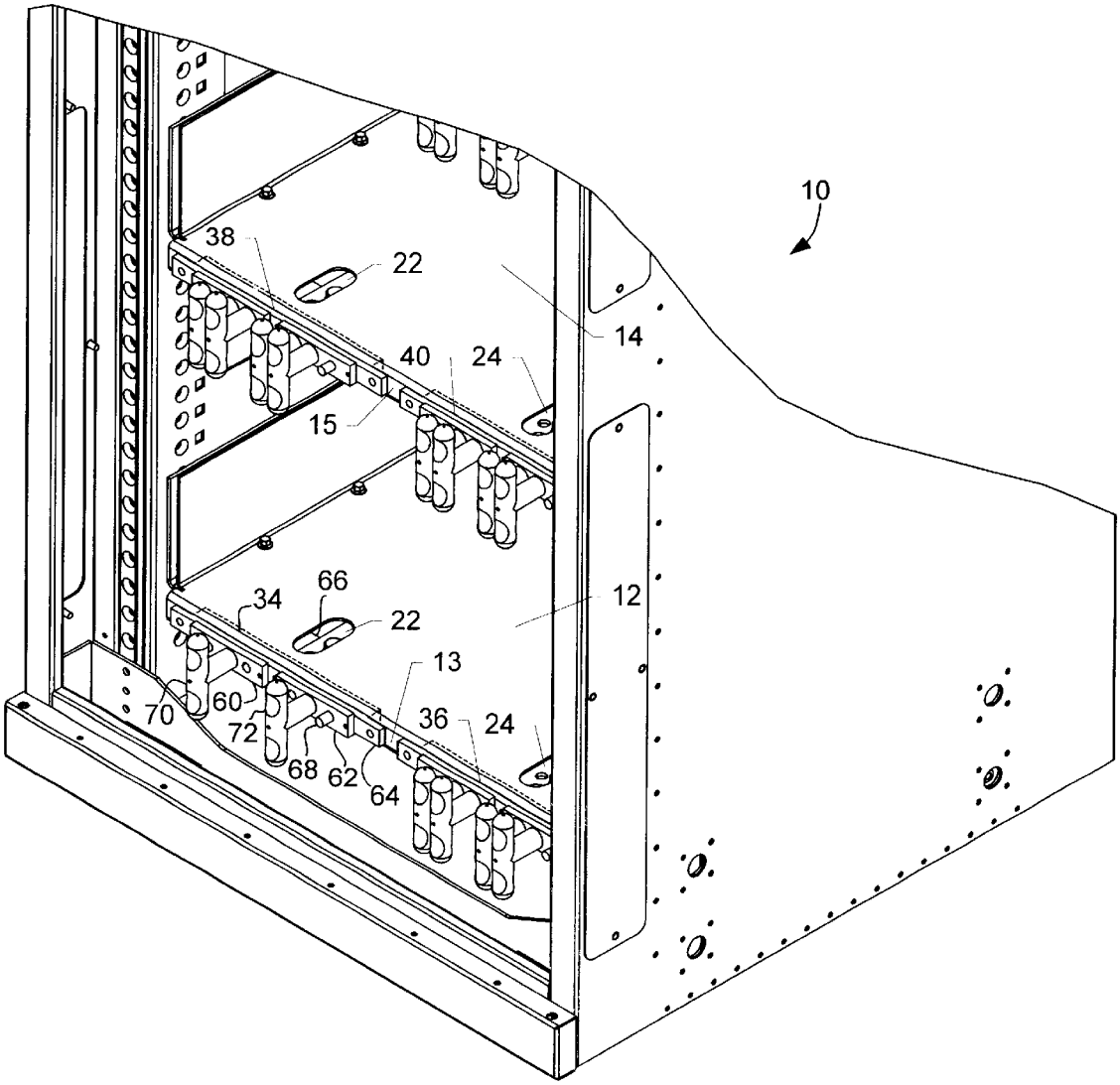
FIG. 2 is a perspective view of details of the cabinet illustrated in FIG. 1.

FIG. 2 is a perspective view of details of the cabinet illustrated in FIG. 1. In FIG. 2, cabinet 10 includes shelves 12, 14 (other shelves 16, 18, 20 are not shown in FIG. 2). Connection assemblies 34, 36 are insertedly mounted into an aperture provided in front edge 13 of shelf 12. A partial indication of hidden portions of connection assemblies 34, 36 is provided by dotted lines in FIG. 2. Connection assembly 34 will be described in detail; other connection assemblies 36, 38, 40, 42, 44, 46, 48, 50, 52 are preferably substantially the same construction as connection assembly 34 so other connection assemblies 36, 38, 40, 42, 44, 46, 48, 50, 52 will not be described in detail in order to avoid redundant prolixity.

Connection assembly 34 includes a pair of first conductive members 60, 62 arranged in abutting relation with an insulating member 64. Insulating member 64 is insertingly mounted in an aperture (not separately indicated in FIG. 2) in front edge 13 of shelf 12. Connection assembly 34 also includes a second conductive member 66 to which bus bar 22 is coupled. First conductive members 60, 62 include connecting posts 68 (only one connecting post 68 is visible in FIG. 2) for connecting batteries that are kept on shelf 12 (no batteries are illustrated in FIG. 2). Connection assembly 34 still further includes bridging members 70, 72, illustrated in FIG. 2 in an installed or inserted orientation. In such an installed orientation bridging members 70, 72 establish electrical coupling or connection between first conductive members 60, 62 and second conductive member 66.

Figure 3:
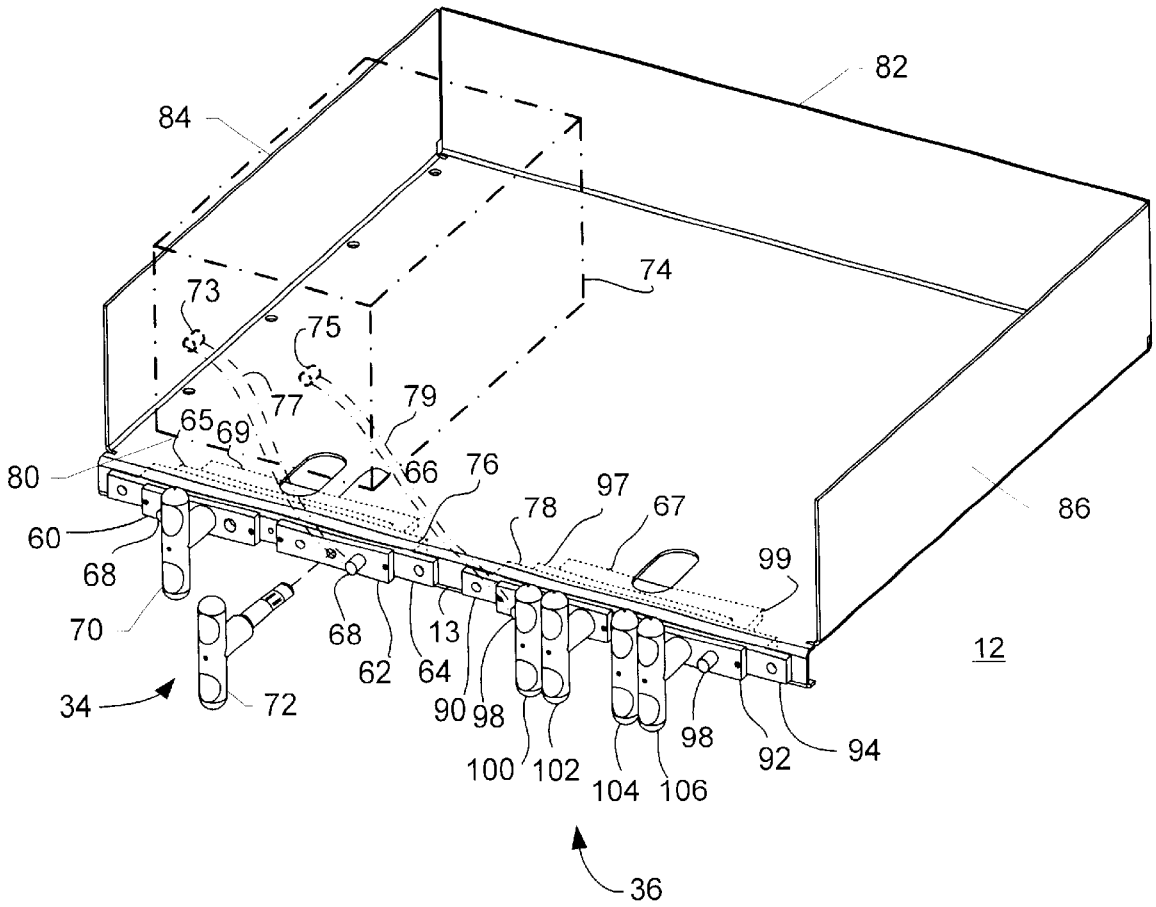
FIG. 3 is a perspective view of details of a shelf used in the cabinet illustrated in FIGS. 1 and 2.

FIG. 3 is a perspective view of details of a shelf used in the cabinet illustrated in FIGS. 1 and 2. In FIG. 3, shelf 12 includes a support portion 80, a rear wall 82 and side walls 84, 86. Preferably rear wall 82 and side walls 84, 86 are fixed with support portion 80 as by bending from a single metal blank, riveting or by another means of affixation. Front edge 13 is preferably integrally formed from support portion 80 as by bending to form a strengthening flange that constitutes front edge 13. Apertures 76, 78 are formed in front edge 13 to accommodate receiving connection assemblies 34, 36.

Connection assembly 34 includes a pair of first conductive members 60, 62 arranged in abutting relation with an insulating member 64. Insulating member 64 is insertingly A mounted in an aperture 76 in front edge 13 of shelf 12. Connection assembly 34 also includes a second conductive member 66 to which bus bar 22 may be coupled (not shown in FIG. 3). Second conductive member 66 is preferably configured in an "L" shape with one leg 65 of the "L" abutting insulating member 64 and the other leg 69 of the "L" extending toward rear wall 82 substantially perpendicular with insulating member 64. Connecting posts 68 are provided for first conductive members 60, 62 to facilitate connecting batteries that are kept on shelf 12. A representative battery 74 is illustrated in FIG. 3 in phantom. Bridging members 70 is illustrated in FIG. 3 in an inserted orientation for establishing electrical connection between first conductive member 60 and second conductive member 66. Bridging member 72 is illustrated in FIG. 3 poised for insertion to establish electrical connection between first conductive member 62 and second conductive member 66.

Connection assembly 36 includes a pair of first conductive members 90, 92 arranged in abutting relation with an insulating member 94. Insulating member 94 is insertingly mounted in an aperture 78 in front edge 13 of shelf 12. Connection assembly 36 also includes a second conductive member 67 to which bus bar 24 may be coupled (not shown in FIG. 3). Second conductive member 67 is preferably configured in an "L" shape with one leg 97 of the "L" abutting insulating member 64 and the other leg 99 of the "L" extending toward rear wall 82 substantially perpendicular with insulating member 64. Connecting posts 98 are provided for first conducting members 90, 92 to facilitate connecting batteries that are kept on shelf 12 (no batteries are illustrated in FIG. 3). Bridging members 100, 102, 104, 106 are illustrated in FIG. 3 in an inserted orientation for establishing electrical connection between first conducting members 90, 92 and second conducting member 67. Four bridging members 100, 102, 104, 106 are provided for connecting assembly 36 to illustrate the ease by which current carrying capacity for connecting assembly 36 may be doubled as compared with connecting assembly 34 that has merely two bridging members 70, 72.

Exemplary shelf 12 is illustrated in FIG. 3 with a representative battery 74 having battery posts 73, 75 coupled by connecting cables 77, 79 with connecting posts 68, 98 to show how one pole of batteries supported by shelf 12 may by connected with one connection assembly 34, and the other pole of batteries supported by shelf 12 may be connected with the other of connection assembly 34, 36. In such manner, for example, positive poles or anodes of batteries may be connected with connecting assembly 34 and negative poles or cathodes of batteries may be connected with connecting assembly 36.

Figure 4:
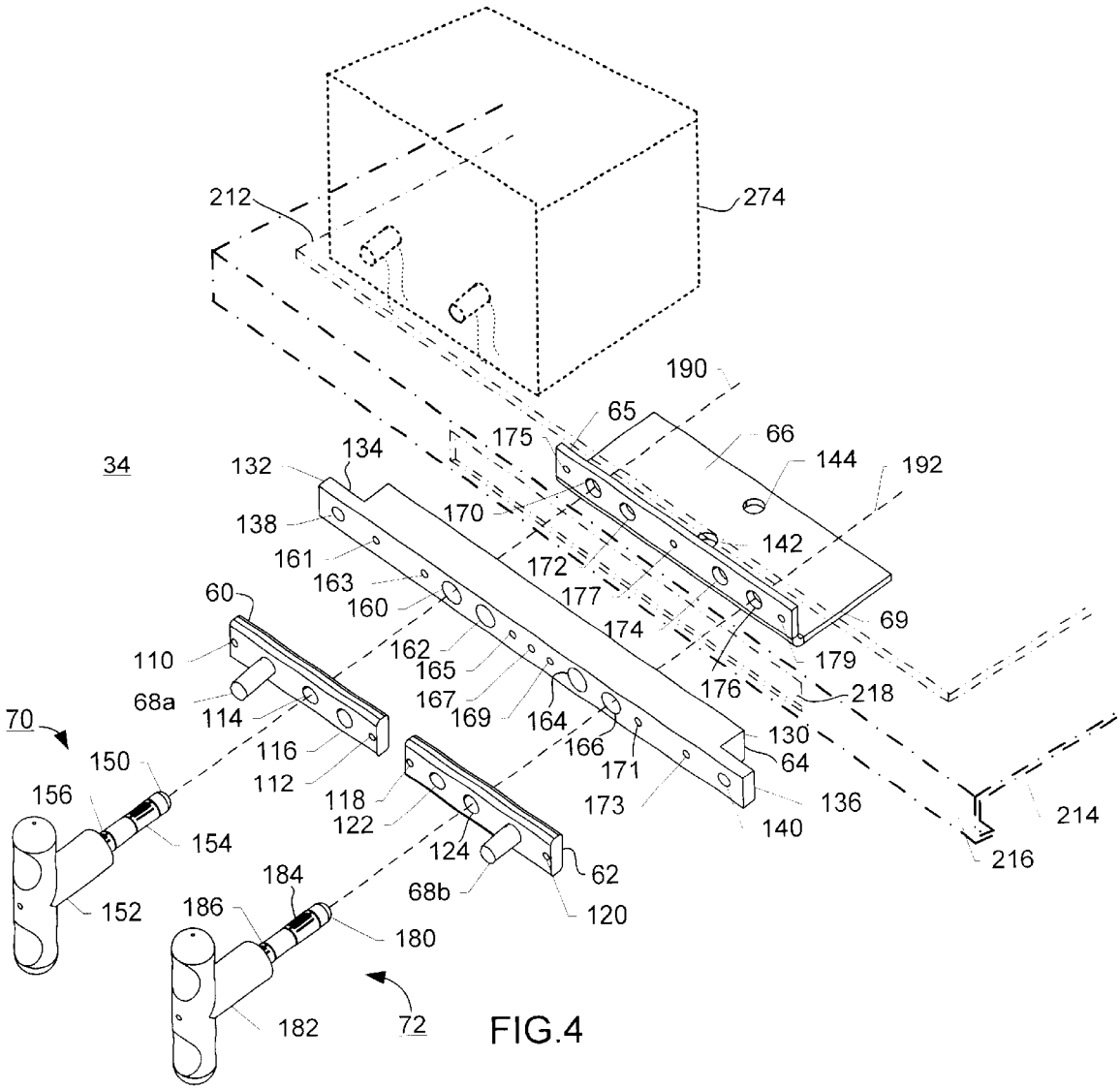
FIG. 4 is an exploded view of the preferred embodiment of the apparatus of the present invention.

FIG. 4 is an exploded view of the preferred embodiment of the apparatus of the present invention. In FIG. 4, connection assembly 34 includes first conductive members 60, 62 poised for assembly in an abutting relation with insulating member 64. First conductive member 60 has mounting apertures 110, 112 for receiving fasteners such as rivets or screws or other fastening devices to affix first conductive member 60 with insulating member 64 for assembly (e.g., as illustrated in FIGS. 1–3). First conductive member 60 also has connector apertures 114, 116 traversing first conductive member 60. A connecting post **68*a* is provided for first conductive member 60 to facilitate connecting batteries that are kept on a shelf. A representative battery 274 resting on a representative shelf 212 is illustrated in phantom in FIG. 4. Also illustrated in phantom is a structural member 214. Structural member 214 may be part of a cabinet (not shown in FIG. 4) that houses shelf 212. Structural member presents a depending frontally facing section 216 preferably integrally formed from structural member 214 as by bending to establish frontally facing section 216 as a strengthening flange. Structural member 214 is representatively illustrated in FIG. 4 as a generally horizontal structural member. Structural member 214 may be a vertical structural member for use with connection assembly 34**.

First conductive member 62 has mounting apertures 118, 120 for receiving fasteners such as rivets or screws or other fastening devices to affix first conductive member 62 with insulating member 64 for assembly (e.g., as illustrated in FIGS. 1–3). First conductive member 62 also has connector apertures 122, 124 traversing first conductive member 62. A connecting post **68*b* is provided for first conductive member 62 to facilitate connecting batteries that are kept on a shelf (e.g., shelf 12; FIGS. 1–3**).

Insulating member 64 configured for mounting in an aperture 218 in frontally facing section 216. Insulating member 64 is configured in a stepped parallelepiped construction with a first parallelepiped portion 130 appropriately sized to clear and pass through aperture 218 and a second parallelepiped portion 132 having extending portions 134, 136 to present a stop structure for denying further passage of insulating member 64 into aperture 218. Insulating member 64 has mounting apertures 138, 140 in extending portions 134, 136 for receiving fasteners such as rivets or screws or other fastening devices to affix connection assembly 34 with a shelf when assembly 34 is in an assembled orientation. Insulating member 64 also includes connector apertures 160, 162, 164, 166 traversing insulating member 64. Insulating member 64 further includes additional mounting apertures 161, 163, 165, 167, 169, 171, 173 to facilitate fixing connection assembly 34 in an assembled orientation.

Second conductive member 66 is configured for connection with a bus bar (e.g., bus bar 22; FIGS. 1–2) using coupling apertures 142, 144 and associated fastening hardware, such as nuts and bolts or other hardware. Second conductive member 66 is preferably configured in an "L" shape with one leg 65 of the "L" abutting insulating member 64 when connection assembly 34 is in an assembled orientation. The other leg 69 of the "L" extends away from insulating member 64 substantially perpendicular with insulating member 64. Second conductive member 66 also includes connector apertures 170, 172, 174, 176 traversing second conductive member 66. Second conductive member 66 further includes mounting apertures 175, 177, 179 to facilitate fixing connection assembly 34 in an assembled orientation.

Bridging member 70 includes a bridging shaft 150 and a handle 152. Handle 152 is preferably configured of insulating material to facilitate grasping and manipulation by a human operator without a need for protective gloves or other equipment. Bridging shaft 150 is preferably configured of an electrically conductive material and is preferably fixedly joined with handle 152. Conductive engaging collars 154, 156 are arranged on bridging shaft 150, preferably in engagement loci that place engaging collars 154, 156 in contact with respective first conductive member 60 and second conductive member 66 when bridging member 70 is in its inserted bridging orientation.

Bridging member 72 includes a bridging shaft 180 and a handle 182. Handle 182 is preferably configured of insulating material to facilitate grasping and manipulation by a human operator without a need for protective gloves or other equipment. Bridging shaft 180 is preferably configured of an electrically conductive material and is preferably fixedly joined with handle 182. Conductive engaging collars 184, 186 are arranged on bridging shaft 180, preferably in engagement loci that place engaging collars 184, 186 in contact with respective first conductive member 62 and second conductive member 66 when bridging member 72 is in its inserted bridging orientation.

To facilitate such a beneficial bridging result, connection assembly 34 is configured so that its assembled orientation (FIGS. 1–3) places connector apertures 114, 160 170 substantially on a common axis 190. Connection assembly 34 is further configured so that its assembled orientation places connector apertures 124, 166, 176 substantially on a common axis 192. Other orientational axes are not illustrated in FIG. 4 in order to avoid cluttering the drawing, however one skilled in the art may easily recognize that the arrangement described above with respect to axes 190, 192 also places other related apertures in substantial alignment. Thus, mounting apertures 110, 161 are substantially coaxial; mounting apertures 163, 175 are substantially coaxial; mounting apertures 112, 165 are substantially coaxial; mounting apertures 167, 177 are substantially coaxial; mounting apertures 118, 169 are substantially coaxial; mounting apertures 171, 179 are substantially coaxial; and mounting apertures 120, 173 are substantially coaxial. Similar alignment is provided among connector apertures. Thus, connector apertures 114, 160, 170 are substantially coaxial; connector apertures 116, 162, 172 are substantially coaxial; connector apertures 122, 164, 174 are substantially coaxial; and connector apertures 124, 166, 176 are substantially coaxial.

Engaging collars 154, 156, 184, 186 are configured to flex from a first relaxed diameter to a smaller second diameter as they are axially displaced (e.g., along axis 190 or axis 192 or another appropriate axis not illustrated in FIG. 4) into or through apertures encountered during urging of bridging members 70, 72 to their inserted orientation. Diameters of connector apertures 114, 170, 116, 172, 122, 174, 124, 176 (that is, connector apertures in first conductive members 60, 62 and second conductive member 66) are preferably sized appropriately to accommodate engaging collars 154, 156, 184, 186 within connector apertures 114, 170, 116, 172, 122, 174, 124, 176 in a snug engagement with engaging collars 154, 156, 184, 186 compressedly flexed. It is preferred that diameters of connector apertures 160, 162, 164, 166 (that is, connector apertures in insulating member 64) be slightly larger than diameters of connector apertures in first conductive members 60, 62 and second conductive member 66 (i.e., connector apertures 114, 170, 116, 172, 122, 174, 124, 176). Such a larger aperture reduces resistance to movement of bridging members 70, 72 to and from their respective inserted orientations, reduces wear in the interior of connector apertures 160, 162, 164, 166, and reduces wear on engaging collars 154, 156, 184, 186.

Figure 5:
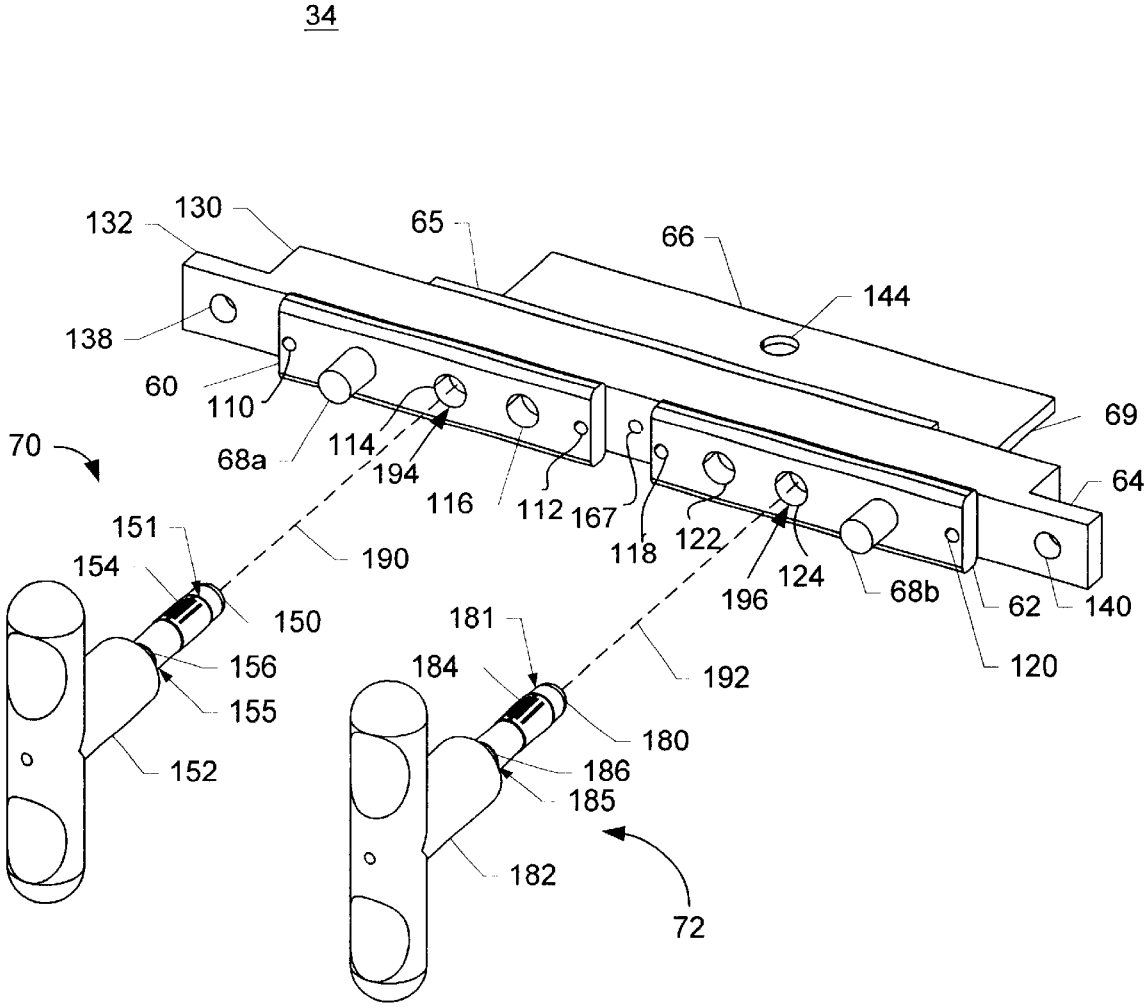
FIG. 5 is a perspective view of the preferred embodiment of the apparatus of the present invention with bridging engagement members poised for insertion to an engaged orientation.

FIG. 5 is a perspective view of the preferred embodiment of the apparatus of the present invention with bridging engagement members poised for insertion to an engaged orientation. In FIG. 5, connection assembly 34 is in an assembled orientation except that bridging members 70, 72 are not inserted. First conductive members 60, 62 and second conductive member 66 are arranged in a substantially parallel relationship separated by insulating member 64. Certain connector apertures cooperate to establish bridging or connector passages along respective axes. Thus, for example, connector apertures 114, 160, 170 (connector apertures 160, 170 are not visible in FIG. 5) cooperate to establish a bridging passage 194 substantially along axis 190. Connector apertures 124, 166, 176 (connector apertures 166, 176 are not visible in FIG. 5) cooperate to establish a bridging passage 194 substantially along axis 192.

Bridging members 70, 72 are poised for insertion to their respective insertion orientations with handles 152, 182 substantially operating as stop structures to limit depth of penetration of bridging shafts 150, 180 within bridging passages 194, 196 as handles 152, 182 abut first conductive members 60, 62. Engaging collar 154 is situated at a first engagement locus 151 on bridging shaft 150 that is appropriate to establish engaging collar 154 within connector aperture 170 (in second conductive member 66; FIG. 4) when bridging member 70 is in its inserted orientation with handle 152 abutting first conductive member 60. Engaging collar 156 is situated at an engagement locus 155 on bridging shaft 150 that is appropriate to establish engaging collar 156 within connector aperture 114 when bridging member 70 is in its inserted orientation with handle 152 abutting first conductive member 60. Engaging collar 184 is situated at a first engagement locus 181 on bridging shaft 180 that is appropriate to establish engaging collar 184 within connector aperture 176 (in second conductive member 66; FIG. 4) when bridging member 72 is in its inserted orientation with handle 182 abutting first conductive member 62. Engaging collar 186 is situated at an engagement locus 185 on bridging shaft 180 that is appropriate to establish engaging collar 186 within connector aperture 124 when bridging member 72 is in its inserted orientation with handle 182 abutting first conductive member 62.

Figure 6:
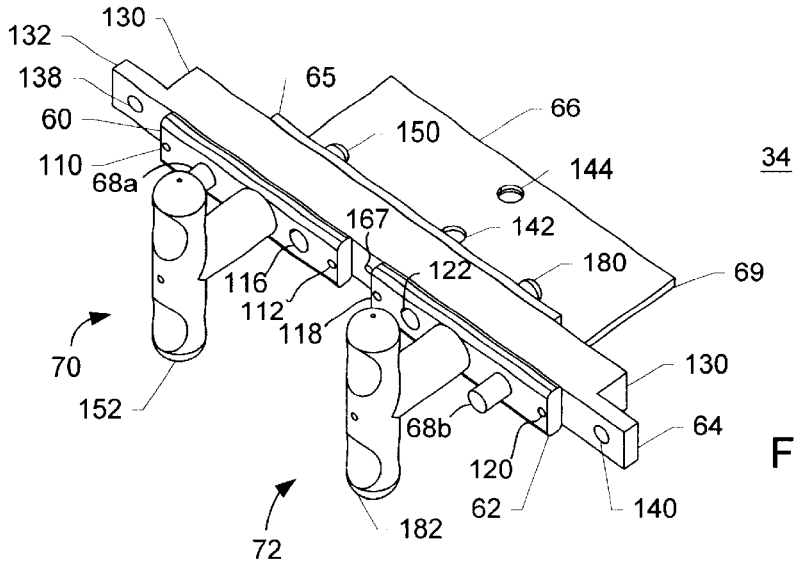
FIG. 6 is a front perspective view of the preferred embodiment of the apparatus of the present invention with bridging engagement members inserted to an engaged orientation.
Figure 7:
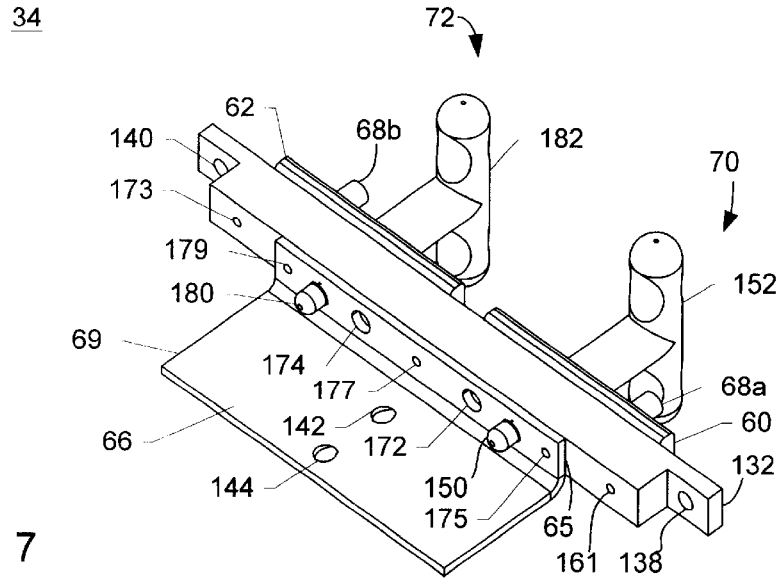
FIG. 7 is a rear perspective view of the preferred embodiment of the apparatus of the present invention with bridging engagement members inserted to an engaged orientation.

FIG. 6 is a front perspective view of the preferred embodiment of the apparatus of the present invention with bridging engagement members inserted to an engaged orientation. FIG. 7 is a rear perspective view of the preferred embodiment of the apparatus of the present invention with bridging engagement members inserted to an engaged orientation. In FIGS. 6 and 7, connection assembly 34 is in its assembled orientation with bridging members 70, 72 installed to effect electrical contact between first conductive members 60, 62 and second conductive member 66 through insulating member 64. Bridging members 70, 72 are fully inserted within connecting assembly 34 with handles 152, 182 abutting first conductive members 60, 62. Bridging shafts 150, 180 are of sufficient length to extend slightly from second conductive member 66, thereby aiding in properly seating bridging members 70,72 within connecting assembly 34 during insertion for effecting desired electrical bridging connection between first conductive members 60, 62 and second conductive member 66.

Figure 8:
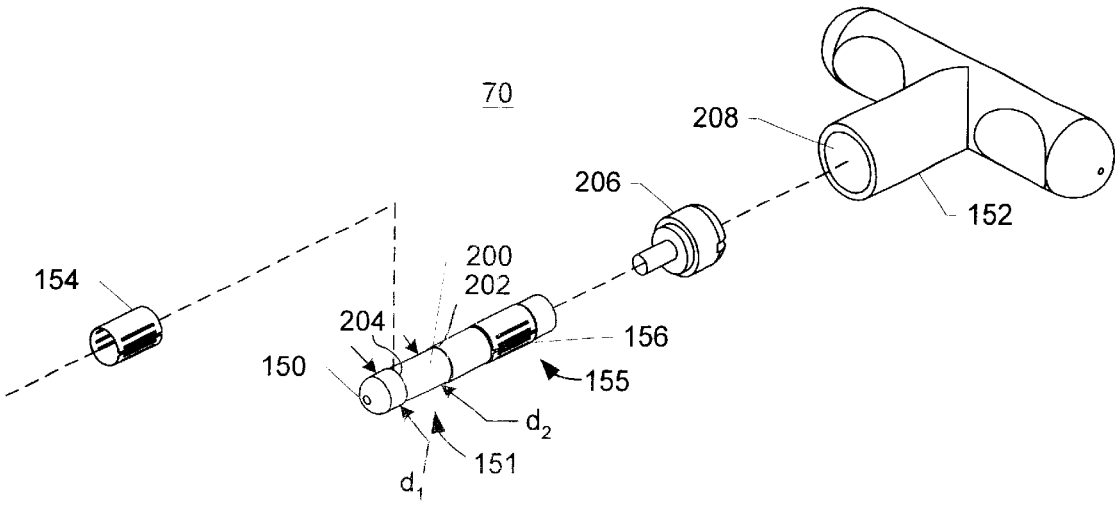
FIG. 8 is an exploded view of the preferred embodiment of the bridging engagement member of the apparatus of the present invention.

FIG. 8 is an exploded view of the preferred embodiment of the bridging engagement member of the apparatus of the present invention. In FIG. 8, bridging member 70 includes bridging shaft 150, handle 152 and engaging collars 154, 156. Engaging collar 155 is situated at a locus 151; engaging collar 156 is situated at a locus 155. Locus 151 is illustrated in detail in its preferred embodiment as a groove 200. Groove 200 is machined or otherwise formed to present a diameter $d_2$ that is less than diameter $d_1$ of bridging shaft 150. Groove 200 presents end walls 202, 204 at which location bridging shaft diameter $d_1$ is presented. Engaging collar 154 is proportioned to encircle diameter $d_2$ of groove 200 and interfere with diameter $d_1$ at end walls 202, 204. By such construction, engaging collar 154 is captively held at locus 151. Preferably, engaging collar 154 is a split collar so that it may be assembled with bridging shaft 150 by urging engaging collar 154 apart at its split sufficiently to slip groove 200 at locus 151 with diameter $d_2$ inside engaging collar 154. Engaging collar 154 thereby is snapped into encircling engagement about bridging shaft 150 at locus 151 to be retained at locus 151. Similar construction for engaging collar 156 and similar dimensioning of locus 155 result in similar retention of engaging collar 156 at locus 155. The split collar construction and snapping encircling engagement within groove 200 is a construction that permits engaging collars 154, 156 to flex sufficiently to effect the required compessive engagement when inserted within a connector aperture in first conductive members 60, 62 or second conductive member 66.

Bridging member 70 may also include a mounting member 206 for mounting bridging shaft 150 with handle 152. Preferably, mounting member 206 is configured to provide transition from diameter $d_1$ of bridging shaft 150 to a closely fitting relation with handle 152, such as within a receiving aperture 208 provided in handle 152. Affixing bridging shaft 150 with handle 152 may be effected in cooperation with mounting member 206 using various affixing mechanisms to unite bridging shaft 150, mounting member 206 and handle 152 into an integral structure including, by way of example and not by way of limitation, adhesive, press fitting, sonic welding or other affixing mechanisms.

Figure 9:
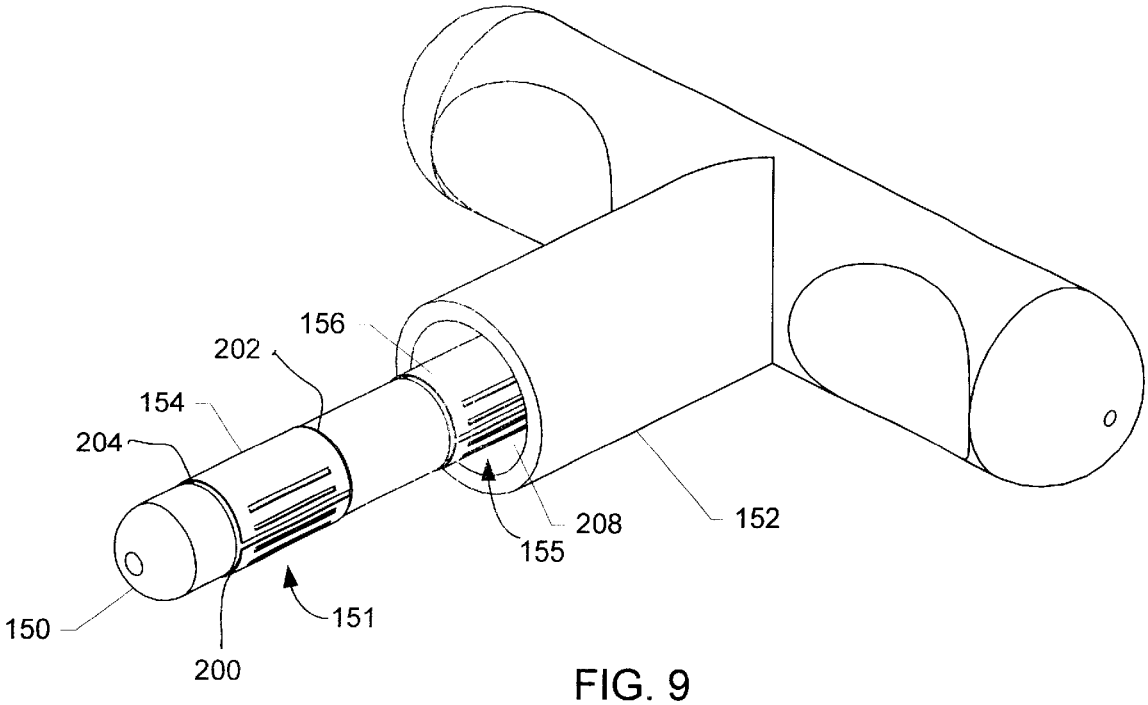
FIG. 9 is a perspective view of an assembled bridging engagement member according to the preferred embodiment of the apparatus of the present invention.

FIG. 9 is a perspective view of an assembled bridging engagement member according to the preferred embodiment of the apparatus of the present invention. In FIG. 9, bridging engagement member 70 is assembled for operational employment and includes handle 152 with bridging shaft 150 securely affixed within receiving aperture 208 (mounting member 206, see FIG. 8, is not visible in FIG. 9). Engaging collar 154 is captively situated at locus 151 in groove 202 between end walls 202, 204. Engaging collar 156 is similarly captively situated at locus 155.

Figure 10:
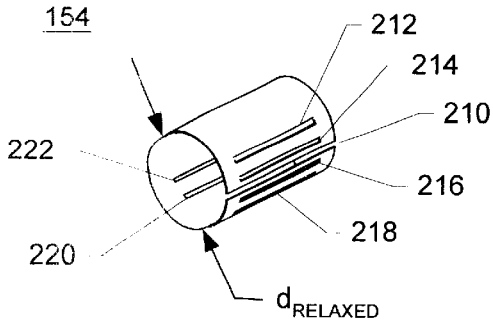
FIG. 10 is a perspective view of the electrically conductive flexing collar used with the bridging engagement member illustrated in FIG. 9.

FIG. 10 is a perspective view of the electrically conductive flexing collar used with the bridging engagement member illustrated in FIG. 9. In FIG. 10, engaging collar 154 is embodied in a flexible generally cylindrical electrically conductive structure having a relaxed diameter $d_{RELAXED}$. A slot 210 is provided to interrupt the completion of the cylindrical construction. Slot 210 permits distorting engaging collar 154 to flexingly snap engaging collar 154 over bridging shaft 150 at locus 151 in order to install engaging collar 154 upon bridging shaft 150, as illustrated in FIG. 9. When engaging collar 154 is in the installed orientation illustrated in FIG. 9, diameter $d_{RELAXED}$ is larger than diameter $d_2$ of groove 200 and smaller than diameter $d_1$ of bridging shaft 150 in sections outside of loci 151, 155. In such manner engaging collar 154 is captively yet movable captured upon bridging shaft 154 at locus 151. In this installed orientation, engaging collar 154 is in a relaxed state having a diameter substantially equal with $d_{RELAXED}$. Slot 210 is in its relaxed orientation.

Preferably $d_{RELAXED}$ is larger than the diameter of connector apertures (e.g., connector apertures 114, 170; FIG. 4) through which engaging collar 154 must pass during installation of bridging member 70 in connecting assembly 34 (FIGS. 4–7). When bridging member 70 is urged into its installed orientation in connection assembly 34, engaging collar 154 flexes to fit within the smaller-diameter connector apertures encountered. Such flexing is permitted by a closing of slot 210 to a somewhat reduced dimension from its relaxed orientation. A plurality of slotted ribs 212, 214, 216, 218, 220, 222 in engaging collar 154 are provided to ensure that engaging collar 154 will pressingly engage a connector aperture in which it is situated when bridging member 70 is in its inserted orientation within connection assembly 34. Each respective slotted rib 212, 214, 216, 218, 220, 222 independently engages an aperture in which it is situated, thus accommodating irregularities in the aperture shape and effecting surer contact with the aperture. In such a manner engaging collar 154 will snugly establish an interference fit within connector aperture 170 (after having passed through connector aperture 114 during insertion of bridging member 70), and engaging collar 156 will snugly establish an interference fit within connector aperture 114.

Figure 11:
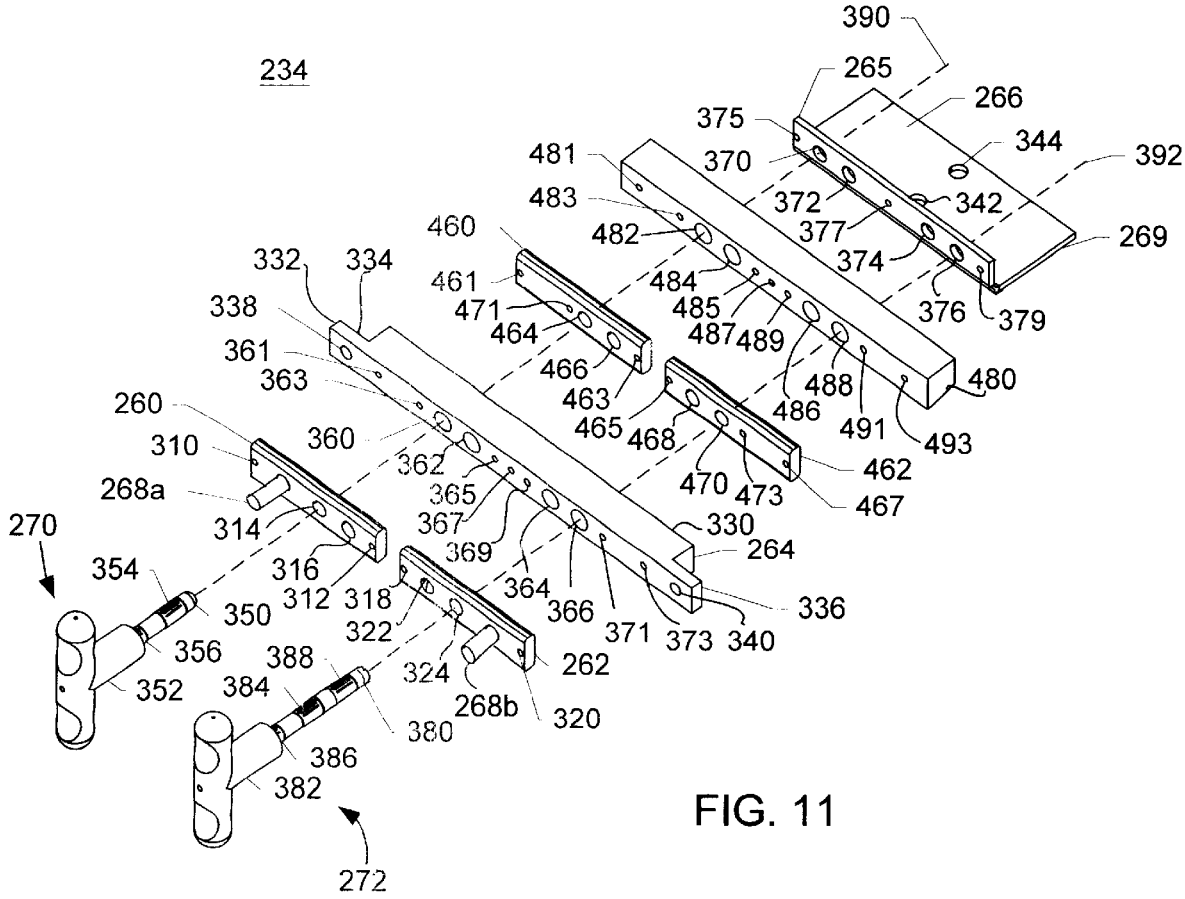
FIG. 11 is an exploded view of an alternate embodiment of the apparatus of the present invention.

FIG. 11 is an exploded view of an alternate embodiment of the apparatus of the present invention. In FIG. 11, a connection assembly 234 includes first conductive members 260, 262 arranged for assembly in an abutting relation with insulating member 264. First conductive member 260 has mounting apertures 310, 312 for receiving fasteners such as rivets or screws or other fastening devices to affix first conductive member 260 with insulating member 264 for assembly. First conductive member 260 also has connector apertures 314, 316 traversing first conductive member 260. A connecting post 268*a* is provided for first conductive member 260 to facilitate connecting batteries that are kept on a shelf (e.g., shelf 12; FIGS. 1–3).

First conductive member 262 has mounting apertures 318, 320 for receiving fasteners such as rivets or screws or other fastening devices to affix first conductive member 262 with insulating member 264 for assembly. First conductive member 262 also has connector apertures 322, 324 traversing first conductive member 262. A connecting post 268*b* is provided for first conductive member 262 to facilitate connecting batteries that are kept on a shelf (e.g., shelf 12; FIGS. 1–3).

Insulating member 264 is configured for mounting in an aperture (e.g., aperture 76 in front edge 13 of shelf 12; FIG. 3). Insulating member 264 is configured in a stepped parallelepiped construction with a first parallelepiped portion 330 appropriately sized to clear and pass through an aperture (e.g., aperture 76 in front edge 13 of shelf 12; FIG. 3) and a second parallelepiped portion 332 having extending portions 334, 336 to present a stop structure for denying further passage of insulating member 264 into the aperture. Insulating member 264 has mounting apertures 338, 340 in extending portions 334, 336 for receiving fasteners such as rivets or screws or other fastening devices to affix insulating member 264 with a front edge of a shelf (e.g., front edge 13 of shelf 12; FIG. 3).

Insulating member 264 also includes connector apertures 360, 362, 364, 366 traversing insulating member 264. Insulating member 264 further includes additional mounting apertures 361, 363, 365, 367, 369, 371, 373 for receiving fastening devices to affix insulating member 264 with first conductive members 260, 262; intermediate conductive members 460, 462; intermediate insulating member 480 and second conductive member 266 to facilitate fixing connection assembly 234 in an assembled orientation.

Intermediate conductive member 460 has mounting apertures 461, 471, 463 for receiving fasteners such as rivets or screws or other fastening devices to affix intermediate conductive member 460 with first conductive members 260, 262; insulating member 264; intermediate insulating member 480 and second conductive member 266 for assembly. Interim conductive member 460 also has connector apertures 464, 466 traversing intermediate conductive member 460.

Intermediate conductive member 462 has mounting apertures 465, 473, 467 for receiving fasteners such as rivets or screws or other fastening devices to affix intermediate conductive member 462 with first conductive members 260, 262; insulating member 264; intermediate insulating member 480 and second conductive member 266 for assembly. Intermediate conductive member 462 also has connector apertures 468, 470 traversing intermediate conductive member 462.

Intermediate insulating member 480 is in a parallelepiped construction configured for passing through an aperture (e.g., aperture 76 in front edge 13 of shelf 12; FIG. 3). Intermediate insulating member 480 includes connector apertures 482, 484, 486, 488 traversing intermediate insulating member 480. Intermediate insulating member 480 also includes mounting apertures 481, 483, 485, 487, 489, 491, 493 for receiving fastening devices to affix intermediate insulating member 480 with first conductive members 260, 262; insulating member 264; intermediate conductive members 460, 462; and second conductive member 266 to facilitate fixing connection assembly 234 in an assembled orientation.

Second conductive member 266 is configured for connection with a bus bar (e.g., bus bar 22; FIGS. 1–2) using coupling apertures 342, 344 and associated fastening hardware, such as nuts and bolts or other hardware. Second conductive member 266 is preferably configured in an "L" shape with one leg 265 of the "L" abutting intermediate insulating member 480 when connection assembly 234 is in an assembled orientation. The other leg 269 of the "L" extends away from intermediate insulating member 480 substantially perpendicular with intermediate insulating member 480. Second conductive member 266 also includes connector apertures 370, 372, 374, 376 traversing second conductive member 266. Second conductive member 266 further includes mounting apertures 375, 377, 379 to facilitate fixing connection assembly 34 in an assembled orientation.

Bridging member 270 includes a bridging shaft 350 and a handle 352. Handle 352 is preferably configured of insulating material to facilitate grasping and manipulation by a human operator without a need for protective gloves or other equipment. Bridging shaft 350 is preferably configured of an electrically conductive material and is preferably fixedly joined with handle 352. Conductive collars 354, 356 are arranged on bridging shaft 350, preferably in engagement loci that place engaging collars 354, 356 in contact with respective first conductive member 260 and second conductive member 266 when bridging member 270 is in its inserted bridging orientation.

Bridging member 272 includes a bridging shaft 380 and a handle 382. Handle 382 is preferably configured of insulating material to facilitate grasping and manipulation by a human operator without a need for protective gloves or other equipment. Bridging shaft 380 is preferably configured of an electrically conductive material and is preferably fixedly joined with handle 382. Engaging collars 384, 386, 388 are arranged on bridging shaft 380, preferably in engagement loci that place engaging collars 384, 386, 388 in contact with respective first conductive member 262, intermediate conductive member 462 and second conductive member 266 when bridging member 272 is in its inserted bridging orientation.

To facilitate a beneficial bridging result, connection assembly 234 is configured so that its assembled orientation places connector apertures 314, 360, 464, 482, 370 substantially on a common axis 390. Connection assembly 234 is further configured so that its assembled orientation places connector apertures 324, 366, 470, 488, 376 substantially on a common axis 392. Other orientational axes are not illustrated in FIG. 11 in order to avoid cluttering the drawing, however one skilled in the art may easily recognize that the arrangement described above with respect to axes 390, 392 also places other related apertures in substantial alignment. Thus, mounting apertures 310, 361, 461, 481 are coaxial; mounting apertures 363, 471, 483, 375 are coaxial; mounting apertures 312, 365, 463, 485 are coaxial; mounting apertures 367, 487, 377 are coaxial; mounting apertures 318, 369, 465, 489 are coaxial; mounting apertures 371, 473, 491, 379 are coaxial; and mounting apertures 320, 373, 467, 493 are coaxial. Similar alignment is provided among connector apertures. Thus, connector apertures 314, 360, 464, 482, 370 are coaxial; connector apertures 316, 362, 466, 484, 372 are coaxial; connector apertures 322, 364, 468, 486, 374 are coaxial; and connector apertures 324, 366, 470, 488, 376 are coaxial.

Engaging collars 354, 356, 384, 386, 388 are configured to flex from a first relaxed diameter to a smaller second diameter as they are axially displaced (e.g., along axis 390 or axis 392 or another appropriate axis not illustrated in FIG. 11) into or through apertures encountered during urging of bridging members 270, 272 to their inserted orientation. Diameters of connector apertures 314, 464, 370, 316, 466, 372, 322, 468, 374, 324, 470, 376 (that is, connector apertures in first conductive members 260, 262; intermediate conductive members 460, 462 and second conductive member 266) are preferably sized appropriately to accommodate engaging collars 354, 356, 384, 386, 388 within connector apertures 314, 464, 370, 316, 466, 372, 322, 468, 374, 324, 470, 376 in a snug engagement with engaging collars 354, 356, 384, 386,388 compressedly flexed. It is preferred that diameters of connector apertures 360, 482, 362, 484, 364, 486, 366, 488 (that is, connector apertures in insulating member 264 and in intermediate insulating member 480) be slightly larger than diameters of connector apertures in first conductive members 260, 262; intermediate conductive members 460, 462 and second conductive member 266 (i.e., connector apertures 314, 464, 370, 316, 466, 372, 322, 468, 374, 324, 470, 376). Such a larger aperture reduces resistance to movement of bridging members 270, 272 to and from their respective inserted orientations, reduces wear in the interior of connector apertures 360, 482, 362, 484, 364, 486, 366, 488, and reduces wear on engaging collars 354, 356, 384, 386, 388.

Connection assembly 234 facilitates electrical coupling in various combinations among power sources and equipment that may be selectively coupled with first conductive members 260, 262; intermediate conductive members 460, 462; and second conductive member 266. Any of the various conductive members 260, 262, 460, 462, 266 may be fashioned as a single piece (e.g., second conductive member; FIG. 11) or as split conductive members (e.g., first conductive members 260, 262; FIG. 11). By providing a selected number of engaging collars for respective bridging members 270, 272 one may select which circuits are to be bridgingly coupled when connecting assembly 234 is in its assembled orientation with bridging members 270, 272 inserted.

Figure 12:
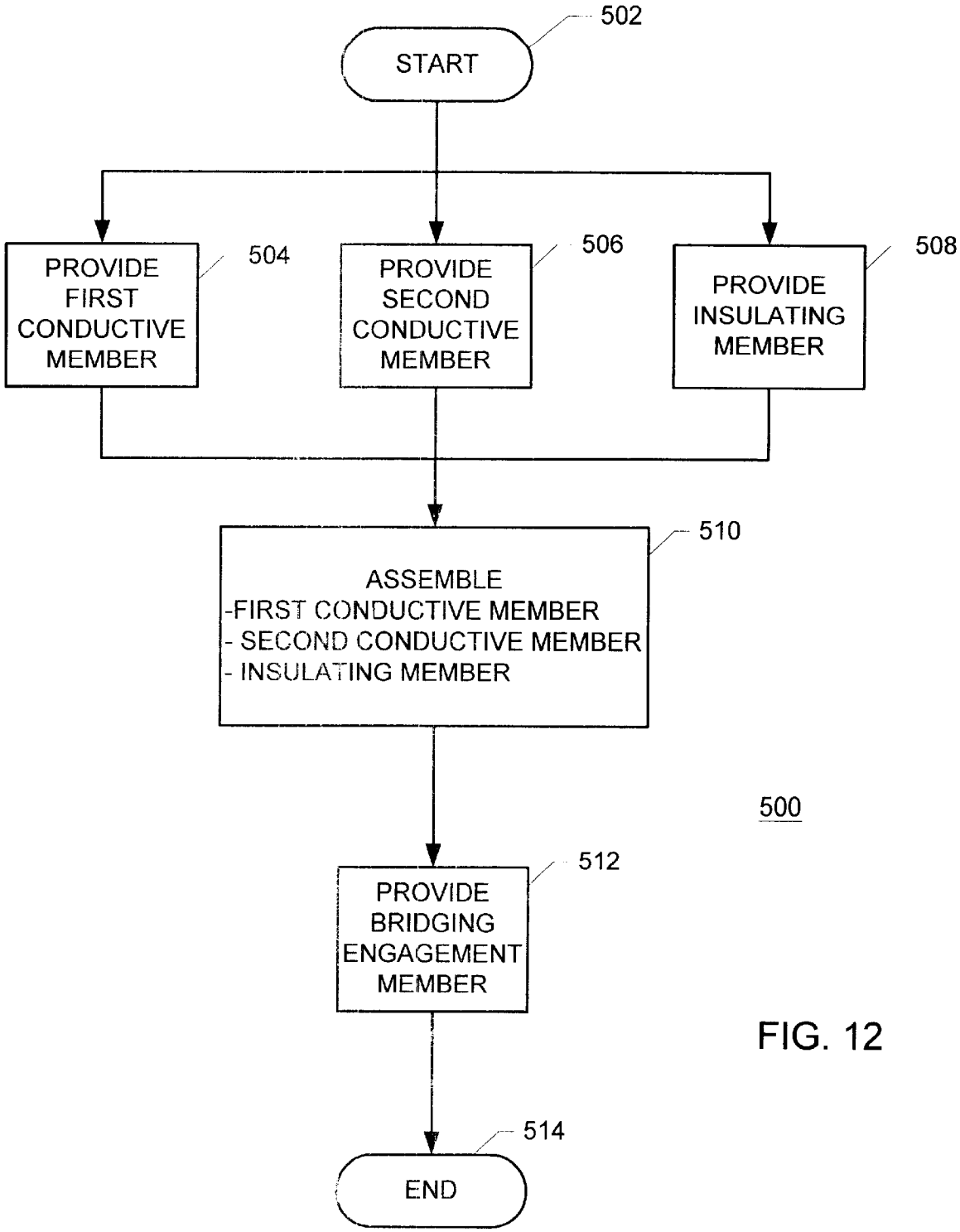
FIG. 12 is a flow chart illustrating the preferred embodiment of the method of the present invention.

FIG. 12 is a flow chart illustrating the preferred embodiment of the method of the present invention. In FIG. 12, a method 500 for effecting electrical connection between a power source and equipment begins at a start locus 502. Method 500 then proceeds, in no particular order with the steps of (1) providing a first conductive member configured for electrical connection with the power source, as indicated by a block 504; the first conductive member has a first aperture traversing the first conductive member; (2) providing a second conductive member configured for electrical connection with the operational equipment, as indicated by a block 506; the second conductive member has a second aperture traversing the second conductive member; and (3) providing an insulating member, as indicated by a block 508.

Method 500 continues with the step of assembling the first conductive member, the second conductive member and the insulating member into an assembled orientation, as indicated by a block 510. In the assembled orientation, the first conductive member and the second conductive member are arranged in a substantially parallel relationship separated by the insulating member. The insulating member has a connecting bore that is substantially coaxial with the first aperture and the second aperture. The connecting bore cooperates with the first aperture and the second aperture to establish a bridging passage extending a bridging distance to traverse the first conductive member, the insulating member and the second conductive member when the apparatus is in the assembled orientation. The bridging passage has a minimum passage diameter.

Method 500 continues with the step of providing a bridging engagement member, as indicated by a block 512. The bridging engagement member includes an electrically conductive rod structure having a length at least equal with the bridging distance along a longitudinal axis. The bridging engagement member has a maximum transaxial dimension perpendicular with the longitudinal axis that is less than the minimum passage diameter. The bridging engagement member has a plurality of engagement structures. A first engagement structure of the plurality of engagement structures is engagingly situated in the first aperture and a second engagement structure of the plurality of engagement structures is engagingly situated in the second aperture when the bridging member is in an engaged orientation. The bridging engagement member is removable from the engaged orientation to interrupt electrical connection between the power source and the equipment.

Method 500 proceeds from block 512 to terminate as indicated by a termination locus 514.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An apparatus for effecting electrical connection among at least one power source and equipment; said equipment being situated in a cabinet on a generally planar shelf member; at least one of said shelf member and said cabinet having a depending member presenting at least one frontal area the apparatus comprising:

(a) at least one insulating member affixed to and traversing said at least one frontal area;

(b) a plurality of electrical bus members affixed to said at least one insulating member; and (c) at least one electrically conductive bridging member;

the apparatus being configured in an assembly with said plurality of bus members and said at least one insulating member alternately arranged to establish a respective insulating member of said at least one insulating member between successive respective bus members of said plurality of electrical bus members; in said assembly a plurality of apertures traverse said successive respective bus members and a plurality of bridging passages traverse selected said respective insulating members; said plurality of apertures and said plurality of bridging passages establishing a plurality of bridging accesses; each respective bridging access of said plurality of bridging accesses traversing at least two said successive bus members; a respective bridging member of said at least one bridging member being removably inserted within a respective said bridging access to an installed orientation; said respective bridging member electrically coupling at least two selected contact bus members of said at least two successive bus members at said respective apertures of said at least two contact bus members to establish electrical continuity among said at least two contact bus members in said installed orientation; at least one contact bus member of said at least two contact bus members being coupled with said at least one power source; at least one contact bus member of said at least two contact bus members being coupled with said equipment.

2. An apparatus for effecting electrical connection among at least one power source and equipment as recited in claim 1 wherein said at least one bridging member includes a plurality of engagement structures; each respective engagement structure of said plurality of engagement structures being located for effecting engaging containment of said respective engaging structure with a respective said aperture for each of said at least two contact bus members in said installed orientation.

3. An apparatus for effecting electrical connection among at least one power source and equipment as recited in claim 1 wherein said at least one frontal area depends from said at least one shelf member.

4. An apparatus for effecting electrical connection among at least one power source and equipment as recited in claim 2 wherein said at least one frontal area depends from said at least one shelf member.

5. An apparatus for effecting electrical connection between a power source and equipment; said equipment being situated on a first generally horizontal generally planar shelf section of a shelf member; said shelf member having a front and a rear; the apparatus comprising:

(a) a first conductive member configured for electrical connection with said power source; said first conductive member having a first aperture traversing said first conductive member;

(b) a second conductive member configured for electrical connection with said equipment; said second conductive member having a second aperture traversing said second conductive member;

(c) an insulating member affixed to a generally planar second shelf section depending from said first shelf section at said front; said insulating member traversing said second shelf section and having a connecting bore; said connecting bore being substantially coaxial with said first aperture and said second aperture to establish a bridging passage extending a bridging distance to traverse said first conductive member, said insulating member and said second conductive member when the apparatus is in an assembled orientation with said first conductive member and said second conductive member arranged in a substantially parallel relationship separated by said insulating member; said bridging passage having a minimum passage diameter; and (d) a bridging engagement member; said bridging engagement member including an electrically conductive rod structure having a length at least equal with said bridging distance along a longitudinal axis and a maximum transaxial dimension perpendicular with said longitudinal axis less than said minimum passage diameter; said bridging engagement member having a plurality of engagement structures; a first engagement structure of said plurality of engagement structures being engagingly situated in said first aperture and a second engagement structure of said plurality of engagement structures being engagingly situated in said second aperture when said bridging member is in an engaged orientation; said bridging engagement member being removable from said engaged orientation to interrupt electrical connection between said power source and said equipment.

6. An apparatus for effecting electrical connection between a power source and equipment as recited in claim 5 wherein each respective engagement structure of said plurality of engagement structures comprises a respective electrically conductive flexing collar attached with a respective said bridging engagement member; a respective said collar having an unflexed diameter larger than a diameter of a respective engagement aperture of said first aperture or said second aperture with which said electrical continuity is established by said respective collar; said respective collar flexing to engagingly interact with a respective said engagement aperture when said respective bridging engagement member is in said engaged orientation.

7. An apparatus for effecting electrical connection between a power source and equipment as recited in claim 6 wherein said collar effects said flexing by a plurality of independently flexing fingers; said plurality of fingers being commonly joined at a base member; said base member being electrically coupled with said respective bridging engagement member.

8. A method for effecting electrical connection between a power source and equipment; said equipment being situated on a generally planar shelf section of a shelf member having a front and a rear; the method comprising the steps of:

(a) in no particular order:

(1) providing a first conductive member configured for electrical connection with said power source; said first conductive member having a first aperture traversing said first conductive member;

(2) providing a second conductive member configured for electrical connection with said operational equipment; said second conductive member having a second aperture traversing said second conductive member; and (3) providing an insulating member affixed to a generally planar second shelf section depending from said first shelf section at said front; said insulating member traversing said second shelf section;

(b) assembling said first conductive member, said second conductive member and said insulating member into an assembled orientation with said first conductive member and said second conductive member arranged in a substantially parallel relationship separated by said insulating member; said insulating member having connecting bore; said connecting bore being substantially coaxial with said first aperture and said second aperture to establish a bridging passage extending a bridging distance to traverse said first conductive member, said insulating member and said second conductive member when the apparatus is in said assembled orientation; said bridging passage having a minimum passage diameter; and (c) providing a bridging engagement member; said bridging engagement member including an electrically conductive rod structure having a length at least equal with said bridging distance along a longitudinal axis and a maximum transaxial dimension perpendicular with said longitudinal axis less than said minimum passage diameter; said bridging engagement member having a plurality of engagement structures; a first engagement structure of said plurality of engagement structures being engagingly situated in said first aperture and a second engagement structure of said plurality of engagement structures being engagingly situated in said second aperture when said bridging member is in an engaged orientation; said bridging engagement member being removable from said engaged orientation to interrupt electrical connection between said power source and said equipment.

9. A method for effecting electrical connection between a power source and equipment as recited in claim 8 wherein each respective engagement structure of said plurality of engagement structures comprises a respective electrically conductive flexing collar attached with a respective said bridging engagement member; a respective said collar having an unflexed diameter larger than a diameter of a respective engagement aperture of said first aperture or said second aperture with which said electrical continuity is established by said respective collar; said respective collar flexing to engagingly interact with a respective said engagement aperture when said respective bridging engagement member is in said engaged orientation.

10. A method for effecting electrical connection between a power source and equipment as recited in claim 9 wherein said collar effects said flexing by a plurality of independently flexing fingers; said plurality of fingers being commonly joined at a base member; said base member being electrically coupled with said respective bridging engagement member.

* * * * *